US005403470A

United States Patent [19]

Kokayeff et al.

[11] Patent Number: 5,403,470

[45] Date of Patent: Apr. 4, 1995

[54] COLOR REMOVAL WITH POST-HYDROTREATING

[75] Inventors: Peter Kokayeff, Fullerton; Robert E. Miller, Yorba Linda; Tuan A. Nguyen, Placentia, all of Calif.

[73] Assignee: Union Oil Company of California, Los Angeles, Calif.

[21] Appl. No.: 71,309

[22] Filed: Jun. 2, 1993

Related U.S. Application Data

[63] Continuation-in-part of Ser. No. 10,598, Jan. 28, 1993.

[51] Int. Cl.[6] ..... C10G 49/04

[52] U.S. Cl. ..... 208/212; 208/210; 208/216 R; 208/217

[58] Field of Search ..... 208/89, 210, 211, 212, 208/254 H, 216 R, 217

[56] References Cited

U.S. PATENT DOCUMENTS

| | | | |
|---|---|---|---|
| 3,340,183 | 9/1967 | Egan | 208/210 |
| 3,850,744 | 11/1974 | Plundo et al. | 208/210 |
| 4,500,424 | 2/1985 | Simpson et al. | 208/216 PP |
| 4,755,280 | 7/1988 | Hudson et al. | 208/89 |
| 4,801,373 | 1/1989 | Corman et al. | 208/210 |
| 4,990,242 | 2/1991 | Louie et al. | 208/218 |
| 5,068,025 | 11/1991 | Bhan | 208/57 |

FOREIGN PATENT DOCUMENTS

| | | | |
|---|---|---|---|
| 0523679 | 1/1993 | European Pat. Off. . | |
| 0523679A2 | 1/1993 | European Pat. Off. . | |
| 3086793 | 4/1993 | Japan | 208/210 |

OTHER PUBLICATIONS

"Gas Oil Deep Desulfurization Process License Agreement", TEC Information Brochure, vol. 18, No. 1 (May 1993), p. 6.

*Primary Examiner*—Paul Lieberman
*Assistant Examiner*—Lorna M. Douyon
*Attorney, Agent, or Firm*—Gregory F. Wirzbicki; Alan H. Thompson

[57] ABSTRACT

Diesel fuels are decolorized by hydrotreatment under mild conditions. The feedstock is normally severely hydrotreated to convert organosulfur or organonitrogen and the effluent passed to a smaller downstream hydrotreating zone at a lower temperature but sufficient to lighten the color of a finished product hydrocarbon.

43 Claims, No Drawings

COLOR REMOVAL WITH POST-HYDROTREATING

RELATED APPLICATIONS

This application is a continuation-in-part application of co-pending U.S. patent application Ser. No. 08/010,598, filed Jan. 28, 1993, the disclosure of which is incorporated by reference in its entirety herein.

BACKGROUND OF THE INVENTION

This invention relates to a catalyzed hydrocarbon conversion process, and particularly to a process involving catalysis of the reaction of hydrogen with organosulfur or organonitrogen compounds to yield a denitrogenated and/or desulfurized product. More particularly, the invention relates to a process for removing color body compounds from hydrocarbon streams and is particularly concerned with the process for removing color body compounds from diesel fuel feedstocks to provide a relatively colorless diesel fuel.

In the refining of liquid hydrocarbons derived from mineral oils and other sources, it is often desirable to subject the liquid hydrocarbon or fraction thereof to hydrotreating. Hydrotreating is a refining process wherein liquid hydrocarbons are reacted with hydrogen. Hydrotreating is often employed to reduce the concentration of organosulfur and organonitrogen compounds in hydrocarbons. Reducing the concentration of organonitrogen and organosulfur produces a product hydrocarbon which, when eventually combusted, results in reduced air pollutants of the forms $NO_x$ and $SO_x$.

In general, the hydrotreating of a organonitrogen and/or organosulfur-containing feedstock is carried out by contacting the feedstock with hydrogen at elevated temperatures and pressures and in the presence of a suitable catalyst so as to convert the organonitrogen to ammonia and the organosulfur to hydrogen sulfide.

Recent legislation has increased the demands for refiners to reduce the content of environmentally undesirable sulfur and nitrogen compounds in solvents and fuel products such as diesel fuels. Catalytic hydrotreating is a useful refining process for such reduction. However, this objective becomes more difficult to meet as heavier crude oils are processed and more cracked stocks, coker gas oils, and light cycle oils obtained from fluid catalytic cracking processes are utilized to obtain such fuel and solvent products—since such feedstocks tend to have increased sulfur or nitrogen content. The increased sulfur or nitrogen contents in such feedstocks typically require the refiner to more severely hydrotreat the feedstocks, i.e., using increased temperature, pressure, hydrogen throughput, lower space velocity, and the like.

It is generally recognized that it is difficult to hydrotreat a feedstock containing diesel fuel and maintain a very good product color. As reactor temperatures of a hydrotreater are increased to meet product specifications for sulfur, nitrogen, etc., the color of the hydrotreated diesel product darkens, (i.e., degrades). In other words, the higher the temperature at which a diesel fuel feedstock is hydrotreated, the darker the color of the liquid hydrocarbon effluent product.

Thus, it is desirable to develop a process whereby color is effectively reduced in a feedstock while minimizing the cost or expenditure of energy to achieve such results. Two relatively expensive approaches to minimizing energy requirements include (1) an increase in the amount or volume of the catalyst, or (2) an increase in the pressure of the reactor-both approaches involving considerable capital expenditure.

Accordingly, the present invention provides a process for removing color bodies from hydrocarbon feedstreams during catalytic hydrotreating, and particularly during severe conditions of hydrotreating. The invention further provides a catalytic process for removing color bodies from feedstreams while utilizing relatively small catalyst and reactor volumes and still maintaining relatively low reactor pressures.

SUMMARY OF THE INVENTION

Briefly, a catalytic hydrotreating process of the invention removes color bodies from a hydrocarbon containing feedstock in a hydrotreating reactor at relatively low pressures and temperatures and, optionally, in the presence of ammonia and/or hydrogen sulfide. Typically, the process of the invention includes passing the feedstock through at least two integrated hydrotreating reaction zones-through an upstream zone under relatively severe conditions and a downstream zone under relatively mild conditions. A feedstock preferably containing diesel fuel and organosulfur and/or organonitrogen compounds is contacted with a catalyst in an upstream reaction zone under relatively severe hydrotreating conditions to produce an effluent containing hydrogen sulfide and/or ammonia and a dark-colored diesel fuel having reduced organosulfur (i.e., typically less than 800 ppmw S) and/or organonitrogen content. Essentially all the effluent is serially contacted with a second hydrotreating catalyst under hydrotreating conditions in a downstream second reaction zone wherein the space velocity is higher and the pressure and temperature are lower than the respective space velocity, pressure and temperature in the upstream reaction zone, but the temperature is still sufficient to lighten the color of the diesel fuel contained in the product effluent.

In a preferred embodiment, essentially all the colored effluent from the first reaction zone is serially passed to a second separate reactor to contact a hydrotreating catalyst under mild hydrotreating conditions comprising a hydrogen partial pressure less than 620 p.s.i.g. and a temperature at least 50° F. less than the temperature in the upstream reaction zone. An effectively decolorized diesel fuel product is obtained from the cooler downstream reaction zone which can further include a smaller catalyst amount than that of the upstream reaction zone. Furthermore, the liquid hourly space velocity (LHSV) of the colored effluent hydrotreated in the downstream reaction zone is at least 1.2 times higher, and can be considerably higher, than that through the upstream reaction zone.

The present invention provides a process for positively imparting decolorization in an integrated hydrotreating system. By the present invention, a petroleum refiner can severely operate an existing hydrotreater under conditions necessary to reduce the sulfur or nitrogen feed content to product specification (such as less than 500 ppmw S) and need not increase the existing hydrotreater reactor volume or catalyst amount, nor increase the pressure, in order to achieve color removal. The refiner simply passes the effluent from the upstream hydrotreater to a relatively small downstream decolorization hydrotreating reactor (usually containing less than one half the volume of catalyst contained in the upstream hydrotreater) which can operate at the same hydrotreating conditions of the existing upstream hydrotreater except for temperature. Compared to a hydrotreating process employing a catalyst bed of a single hydrotreating reaction zone, the multiple reaction zone system of the present invention provides a greater overall reduction in reactor volume by at least 50 percent and still achieves similar color removal results.

DETAILED DESCRIPTION OF THE INVENTION

Hydrocarbon feedstocks are catalytically treated in the presence of elevated hydrogen pressures in a hydrotreating reaction zone containing a catalyst bed maintained at a temperature normally less than about 650° F. but sufficient to reduce color in the feedstock, i.e., lighten the visible color of hydrocarbon components of the feedstock. Preferably, such a temperature is sufficiently maintained in a downstream portion of the catalyst bed to reduce color in previously processed hydrocarbons and is typically at least 25° F. lower than the temperature in an upstream portion of the catalyst bed. The feedstock preferably contacts one or more hydrotreating catalysts serially in two or more reaction zones under different temperature conditions. The downstream reaction zone has a lower weighted average catalyst bed temperature than the weighted average catalyst bed temperatures of the upstream reaction zone and, optionally, may also contain a smaller amount of catalyst (i.e., one half or less volume of catalyst compared to that contained in the upstream reactor). The extent of reduction of the temperature (and, optionally, the amount of catalyst or reactor volume) in the downstream catalyst bed or downstream reaction zone (as compared to that in the upstream portions) is, in part, determined by the extent of desired reduction of color bodies from feedstock to finished product.

Contemplated for treatment by the process of the invention are hydrocarbon-containing oils, including broadly all liquid and liquid/vapor hydrocarbon mixtures such as crude petroleum oils and synthetic crudes. Among the typical hydrocarbon feedstocks contemplated are gas oils, particularly vacuum gas oils, distillate fractions of gas oils, thermally cracked or catalytically cracked gas oils, decant oils, creosote oils, shale oils, oils from bituminous sands, coal-derived oils, and blends thereof, which contain color bodies and may contain sulfur, nitrogen and/or oxygen compounds. The process may be applied advantageously to the hydrogenation of substantially any individual hydrocarbon, mixtures thereof, or mineral oil fractions boiling in the range of about 300° F. to about 750° F. which contain color bodies or produce color bodies when hydrotreated. Preferred feedstocks comprise mineral oil fractions boiling in the solvent naphtha, turbine fuel or diesel fuel ranges. Specifically contemplated feedstocks comprise solvent fractions boiling in the range of about 300° to about 400° F., turbine fuel fractions boiling in the range of about 350° to about 550° F., diesel fuel fractions boiling in the range of about 350° to about 750° F. and the like.

A highly preferred feedstock processed in the present invention contains a substantial proportion (i.e., more than 90 volume percent, and, in some cases, essentially all) of feedstock components boiling at less than 700° F., particularly a diesel fraction. The preferred feedstock is not a lube oil and ordinarily contains at least one light coker gas oil, straight-run diesel fuel, a hydrocracked diesel fuel, or a light cycle oil obtained from a fluid catalytic cracking process, and mixtures and blends thereof. A typical feedstock contains at least 1 ppmw of nitrogen components (calculated as N), typically at least 10 ppmw, and preferably between about 10 and about 5,000 ppmw of nitrogen components, and at least about 1 ppmw of sulfur components (calculated as S), usually greater than about 500 ppmw, preferably between about 0.02 and about 4.0 weight percent, and most preferably greater than about 1.25 weight percent. The nitrogen components and the sulfur components are generally present in the feedstock essentially completely in the form of organonitrogen and organosulfur compounds, respectively, particularly in the feedstock contacting the catalyst in a first reaction zone. The nitrogen components and the sulfur components are generally present in the effluent from a first reaction zone (which passes to a downstream second reaction zone) in the form of organonitrogen compounds and ammonia, and organosulfur compounds and hydrogen sulfide, respectively. The API (American Petroleum Institute) gravity of the feedstocks of the present invention are typically greater than about 15, and preferably about 15 to about 50. The kinematic viscosity of the feedstock is typically less than 5 and greater than 1 centistokes (CST) at 40° C., and preferably in the range from about 2 to about 4 (CST at 40° C.), such feedstock volumes being determined in accordance with ASTM D-975 as described in the 1992 *Annual Book of ASTM Standards*, in Sec. 5, entitled "Petroleum Products, Lubricants and Fossil Fuels," Vol. 05.01 (D56-D1947), ASTM (1992), Philadelphia, Pa., the disclosure being incorporated by reference in its entirety herein. The most highly preferred feedstock is a Diesel No. 2 according to ASTM D-975.

Hydrotreating catalysts employed in either the upstream or downstream reaction zones in the present invention can be the same or different catalysts. Such catalysts typically contain at least one hydrogenation metal component on a porous refractory oxide support and/or have at least some activity for hydrotreating hydrocarbon-containing feedstocks to convert sulfur and/or nitrogen components of the feedstock to hydrogen sulfide and/or ammonia, respectively. Furthermore, the catalyst employed in the downstream reaction zone has at least some activity for converting or removing color bodies from a hydrocarbon-containing liquid. A preferred catalyst contains at least one Group VIB metal hydrogenation component and/or at least one Group VIII metal hydrogenation, and optionally and preferably, at least one phosphorus component on the porous refractory support. In a highly preferred embodiment, the catalyst contains at least one cobalt or nickel hydrogenation component, at least one molybdenum or tungsten hydrogenation component, and at least one phosphorus component supported on an amorphous, porous refractory oxide containing alumina, preferably gamma alumina.

Porous refractory oxide support material of the catalysts employed herein typically contains amorphous, porous inorganic refractory oxides such as silica, magnesia, silica-magnesia, zirconia, silica-zirconia, titania, alumina, silica-alumina, etc., with supports containing gamma, theta, delta and/or eta alumina being highly preferred. Such support material is utilized to prepare catalysts having physical characteristics including a total pore volume greater than about 0.2 cc/gram and a surface area greater than about 100 $m^2$/gram. Ordinarily the total pore volume of the catalyst is about 0.2 to about 1.0 cc/gram, and preferably about 0.25 to about 0.80 cc/gram, and the surface area is in the range from about 150 to about 500 $m^2$/gram, and preferably about 175 to about 350 $m^2$/gram.

Hydrotreating catalysts employed in the invention typically contain porosities wherein a majority of the pore sizes are of diameters from about 40 to about 300 angstroms with a median pore diameter from about 50 to about 200 angstroms. Preferred catalysts have a relatively narrow pore size distribution wherein at least about 75 percent, more preferably at least about 80 percent, and most preferably at least about 85 percent of the total pore volume is in pores of diameter from about 50 to about 110 angstroms or from about 70 to about 130 angstroms. Another porosity feature of preferred catalysts employed herein is the narrow pore size distribution of pores of diameter slightly above or below the median pore diameter which typically lies in the range from about 65 to about 120 angstroms, preferably about 70 to about 100 angstroms. Ordinarily, at least about 50 percent of the total pore volume of the catalysts is contained in pores of diameter within 50 angstroms of the median pore diameter.

Examples of hydrogenation metals loadings and physical characteristics of preferred catalysts for use herein are disclosed in U.S. Pat. Nos. 4,846,961 issued to Robinson et. al., 4,686,030 issued to Ward, and 4,500,424 issued to Simpson et al., the disclosures of which are incorporated by reference herein in their entireties. For example, the hydrotreating catalyst may contain at least 17, usually 17 to 30, and preferably at least 19 weight percent of molybdenum components, calculated as $MoO_3$, about 1 to about 8 weight percent of cobalt or nickel components, calculated as the monoxide, and about 1 to about 6 weight percent of phosphorus components, calculated as P, on a porous refractory oxide support, preferably containing alumina. Such exemplary catalysts can readily be employed in suitable upstream and/or downstream locations in the multi-catalyst bed of the invention.

The catalyst is typically employed as a fixed bed of particulates in a suitable reactor vessel wherein the feedstock to be treated is introduced and subjected to elevated conditions of pressure and temperature, and ordinarily a substantial hydrogen partial pressure, so as to effect the desired degree of color reduction and sulfur or nitrogen reduction in the feedstock. The particulate catalyst is maintained as a fixed bed with the feedstock passing upwardly or downwardly therethrough, and most usually downwardly therethrough. Although any conventional method of catalyst activation may be employed, such catalysts employed in the process of the invention are usually activated by sulfiding prior to use (in which case the procedure is termed "presulfiding"). Presulfiding may be accomplished by passing a sulfiding gas or sulfur-containing liquid hydrocarbon over the catalyst in the calcined form; however, since the hydrocarbon feedstocks and effluents treated in the invention ordinarily contain sulfur impurities, one may also accomplish and maintain the sulfiding in situ. Ordinarily, in the invention at least 1, and preferably 10 ppmv, of hydrogen sulfide is passed through the hydrotreating catalyst bed in which the color of the finished product hydrocarbon is to be improved.

In one embodiment of the invention, a hydrocarbon feedstock is passed through a single reactor containing the sulfided catalyst bed at a temperature from about 250° F. to about 650° F., but sufficient to lighten the feedstock. However, a single reactor preferably contains means for maintaining an upstream portion of the catalyst bed at a different temperature than a downstream portion of the bed during processing. Temperature controlling means include either cooling (quench) gas or recycle streams (such as recycled hydrogen gas or recycled cold product hydrocarbon obtained from the downstream catalyst bed) selectively positioned along upstream and downstream portions of the catalyst bed, and heat exchangers positioned along the bed. Alternatively, the catalyst may be utilized in two or more separate reactors, such as in a multiple train reactor system having the reactors loaded with one or more types of catalyst. Furthermore, one or more reactors may be loaded with one type of catalyst and the remaining reactors with one or more other catalysts. In such multiple reactor embodiments, temperature controlling means are typically located between reactors; however, it is within the scope of the invention that each reactor in a multiple train also have temperature controlling means along the reactor catalyst bed, as for instance, by external heat exchange, a cold recycled product hydrocarbon obtained from a downstream reactor, or a cold fresh or recycled hydrogen-containing quench. In either the single reactor system or the multiple reactor systems, the individual reaction zones are generally operated under an independent set of hydrotreating conditions selected from those shown in the following TABLE A:

TABLE A

| | Suitable Range | Preferred Range |
|---|---|---|
| Upstream Operating Conditions | | |
| Temperature, F. | 250–900 | 550–800 |
| Hydrogen Partial Pressure | 150–3,500 | 200–2,000 |
| Space Velocity, LHSV | 0.1–<10 | 0.5–<5.0 |
| Recycle Gas Rate, scf/bbl | 500–35,000 | 1,000–30,000 |
| Downstream Operating Conditions | | |
| Temperature | 250–650 | 300–600 |
| Hydrogen Partial Pressure | 100–620 | 300–600 |
| Space Velocity, LHSV | >5.0–40 | 6–20 |
| Recycle Gas Rate, scf/bbl | 500–35,000 | 1,000–30,000 |

The weighted average catalyst bed temperature (WABT) for a typical commercial tubular reactor having a constant catalyst density and a linear temperature increase through the length of the bed is the average of the temperatures of the hydrocarbon feedstock at the inlet and outlet of the reactor. When the temperature increase through a catalyst bed is not linear, the temperatures of the weighted portions of the catalyst at selected bed locations must be averaged in accordance with the equation $(WABT)=\Sigma T\Delta W/W$ wherein WABT is the weighted average catalyst bed temperature, W is the weight of the catalyst, $\Delta W$ is the weight of a portion of the catalyst bed having a given average temperature T. (When the catalyst reactor bed has a constant catalyst density, then $\Sigma T\Delta W/W=\Sigma T\Delta L/L$ wherein L is the reactor bed length and $\Delta L$ is the length of a portion of the catalyst bed having a given average temperature T.) For example, a tubular reactor having a 15 foot catalyst bed with constant catalyst density and having a reactor inlet temperature of 700° F. and a reactor outlet temperature of 750° F. has a weighted average catalyst bed temperature of 716.7° F. when the temperatures are 705° F. and 720° F. at the 5 and 10 ft. catalyst bed positions, respectively.

Determination of the weighted average bed temperature of a portion of the overall catalyst bed in a single reactor (such as an upstream or downstream portion) is accomplished in the same manner as hereinbefore mentioned except the temperatures of the hydrocarbon feedstock cannot, in all cases, be measured at the inlet or outlet of the reactor. Temperatures along the catalyst bed of a single reactor are detected by temperature detecting means, such as thermocouples, positioned along the catalyst bed. In a single reactor system, the weighted average bed temperature of an upstream portion of catalyst bed may be determined by a thermocouple at the inlet of the reactor and another at a location within the bed prior to the outlet. The weighted average bed temperature of a downstream portion of a single reactor catalyst bed may be determined by a thermocouple at a given location within the bed and another at the outlet of the reactor.

In one single reactor embodiment, the upstream and downstream portions of the catalyst bed are contacted by a hydrocarbon feedstock at temperatures determined from concentrations of color bodies in the respective portions of the feedstock contacting the upstream and downstream portions of the catalyst. In general, the higher temperature (WABT) of an upstream portion of the catalyst bed must be sufficient to provide catalytic activity to convert organosulfur or organonitrogen compounds contained in the feedstock to provide a product effluent having a desired concentration of organosulfur or organonitrogen remaining in the hydrocarbon oil, i.e., provide sufficient energy to achieve a desired desulfurization or denitrogenation reaction rate. The lower temperature (WABT) of a downstream portion of the catalyst bed must be lower than the temperature of the upstream portion of the catalyst bed, yet still effect conversion of a substantial proportion of color bodies remaining in the effluent from the upstream catalyst bed so as to provide a finished product hydrocarbon having a remaining smaller amount of color bodies, e.g., color reduction. The downstream catalyst bed can be cooled by a fresh or recycled hydrogen quench gas or by recycling a portion of the cooled product hydrocarbon. The temperatures (WABT) of downstream portions of the catalyst bed are determined from the concentrations of color bodies contained in the corresponding downstream portions of the feedstock whereas the temperatures (WABT) of upstream portions of the catalyst bed are initially determined from kinetic considerations, including catalyst activity, and operating conditions, including space time necessary to achieve a given degree of organosulfur or organonitrogen conversion, i.e., a given desulfurization or denitrogenation reaction rate. (Space time as used herein is the time the catalyst is in contact with the feedstock.) The net effect in the downstream portion of the catalyst bed is a higher reaction rate of color body conversion at a lower temperature.

In a preferred embodiment of the invention, a hydrocarbon feedstock is successively passed through at least two reaction zones, i.e. an upstream first zone and a downstream second zone, the upstream zone containing a catalyst having activity for converting organosulfur or organonitrogen compounds and the downstream second zone catalyst being sulfided and having activity to remove or convert color bodies, at hydrotreating conditions in accordance with the conditions disclosed in Table A herein. The integrated process of the invention typically operates at a hydrogen partial pressure of less than 620 p.s.i.g. in both the upstream and downstream reaction zones, and the LHSV in the upstream reaction zone is usually less than 5.0 while that in the downstream reaction zone is greater than 5.0. Preferably, the hydrotreating conditions in the downstream second reaction zone are a hydrogen partial pressure from about 300 to about 610 p.s.i.g., a hydrogen recycle rate from about 1,000 to about 5,000, a liquid hourly space velocity from about 6 to about 15, and a temperature in the range from about 250° F. to about 650° F., more preferably from about 425° to about 575° F., and most preferably from about 440° F. to about 560° F. It is highly preferred that the hydrogen partial pressure in the downstream reactor zone (i.e., predominant color removing zone) be in the range from about 490 to 620, and most preferably from 570 to 610 p.s.i.g. The LHSV in the downstream reaction zone is often in the range from about 7 to about 15, and most preferably higher than about 7.5.

In the preferred integrated process, essentially all of the product effluent including hydrogen, hydrogen sulfide, ammonia and hydrocarbon-containing product obtained from the upstream first reaction zone is directly passed into the downstream second reaction zone; thus, a connective relationship exists between the zones. In this connective relationship, there is a mild loss of hydrogen partial pressure between the zones, e.g., the outlet hydrogen partial pressure from the upstream first reaction zone is at least about 3 p.s.i.g. lower, and usually about 5 to about 20 p.s.i.g. lower than the inlet hydrogen partial pressure to the downstream second reaction zone—particularly when a heat exchanger is positioned between reaction zones. "Hydrogen partial pressure," as used herein, refers to the average hydrogen partial pressure across a stated hydrotreating catalyst bed—across the hydrotreating catalyst bed in the upstream reaction zone or across the hydrotreating catalyst bed in the downstream reaction zone—while the terms "inlet hydrogen partial pressure" and "outlet hydrogen partial pressure" refer to the hydrogen partial pressure determined at the respective inlet and outlet to the particular reaction zone.

The organosulfur concentration of the effluent obtained from the upstream reaction zone is typically less than 2,000 ppmw sulfur (calculated as S), preferably less than 500 ppmw S, and often in the range from 0 to about 800 ppmw S and most preferably from 0 to less than 450 ppmw S. One of the unusual features of the process of the invention is that such low organosulfur concentrations can be obtained at a relatively low hydrogen partial pressure, e.g., less than 620 p.s.i.g. (and most preferably an inlet hydrogen partial pressure less than 615 p.s.i.g.), in the downstream reaction zone, while still achieving suitable color for the finished product hydrocarbon liquid from the downstream reaction zone. Furthermore, surprisingly suitable color and color stability is obtained for the finished product hydrocarbon liquid when the hydrogen partial pressure in the downstream (decolorization) reaction zone is lower than the hydrogen partial pressure in the upstream (desulfurization) reaction zone—usually at least about 5 p.s.i.g. lower, preferably about 10 to about 100 p.s.i.g. lower, and most preferably about 25 to about 75 p.s.i.g. lower.

The color of hydrocarbon-containing liquids or vapors initially hydrotreated (feedstocks) or subsequently produced in the present process of the invention (intermediate effluents and product hydrocarbons) range, inter alia, from very dark to amber to straw yellow to light yellow to water-white or essentially colorless. As used herein, color body compounds, i.e., "color bodies," contained in such hydrocarbon liquids or vapors effect the color of the liquids or vapors, and are the organic species in the hydrocarbon liquids which absorb light in the visible range, i.e., substances absorbing light of wave lengths from 400 to 800 nanometers. Non-color bodies, as used herein, are species which do not absorb visible light. The visually darker-colored hydrocarbon liquids contain more color bodies than lighter-colored liquids. In the invention, color reduction is achieved by removal and/or conversion of color bodies from the hydrocarbon-containing liquids or vapors. Color body removal includes conversion of color bodies to non-color bodies. The amount of color reduction is evidenced by the color bodies remaining in the finished product hydrocarbon relative to the content of color bodies in the effluent obtained from the upstream first reaction zone. Such a color reduction is determined by visual or instrumental analysis of the finished product hydrocarbon.

In addition to ordinary visual distinctions, the color of the liquid hydrocarbons, including finished product hydrocarbons, initial feedstocks and intermediate effluents, can be determined from color scales by color tests measured in accordance with ASTM D-156 (known as Saybolt) or ASTM D-1500 (both tests disclosed in the 1992 Annual Book of ASTM Standard, supra), these test procedures and color scales being incorporated by reference in their entireties herein. The ASTM D-1500 color scale ranges from 0 to 8, with 8 being darkest, and the Saybolt color scale ranges from −16 to 0 to +, with −16 being darkest and +30 being lightest or colorless. For purposes of the present invention, a "colorless" finished product hydrocarbon indicates a Saybolt color value greater than 20. Typically, Saybolt values from approximately −14 to −16 overlap with values from approximately 0.5 to 0 on the ASTM D-1500 color scale. Thus, color values from 8 toward about 1 (i.e., greater than about 1.0) are typically a measurement of darker colors than any number on the Saybolt scale. Conversely, Saybolt numbers greater than approximately −14 are typically lighter than any number on the ASTM D-1500 color scale.

In the process of the invention, the amount of color bodies remaining in the finished product hydrocarbon as a result of contact with a downstream portion of the catalyst bed at a lower temperature is dependent upon the particular finished product hydrocarbon specifications. For example, typical diesel fuels may require a sufficiently low percent of color bodies to provide a desired colorless finished product hydrocarbon. In general, at least 25 percent of the color bodies in the feedstock initially contacting the upstream portion of the catalyst bed (i.e., first reaction zone) are converted to non-colored compounds in the finished product hydrocarbon obtained after contact of the downstream portion of the catalyst bed or from the effluent of the last reaction zone. By the present invention, the color of either the feedstock or the effluent from the upstream zone is typically reduced by an increase of at least 3.0, and preferably at least 10.0 Saybolt numbers, or by a decrease of at least 0.5, and preferably at least 3.0 whole numbers on the ASTM D-1500 color scale.

At the start or during the course of a processing run, the weighted average catalyst bed temperature in a downstream second reaction zone is intentionally lowered at least 25° F., preferably at least 50° F., and ordinarily from about 100° F. to about 400° F., and preferably from about 100° F. to about 300° F., as compared to the weighted average bed temperature of an upstream first reaction zone. To the same extent, the weighted average bed temperature of the first reaction zone may also be raised as compared to the weighted average bed temperature of the second reaction zone; however, the weighted average bed temperature of the second reaction zone must still be low enough to sufficiently convert color bodies to non-color bodies contained in the finished product. Preferably throughout a run designed to reduce a desired portion of color bodies from the effluent obtained from the upstream reaction zone, the difference between the inlet temperature in the first reaction zone and the inlet temperature in the downstream second reaction zone is at least 25° F., preferably at least 50° F. and most preferably at least 100° F. It is highly preferred that the inlet temperature of the downstream reaction zone be lower than both the inlet and outlet temperature of the first reaction zone, and typically by at least 25° F. and usually in the range from about 50° F. to about 400° F.

Although some color bodies may be converted to non-color bodies in the upstream portions of the catalyst bed or in a first reaction zone, the lower temperature in the downstream bed portion or second reaction zone provides a substantial and significant reduction of color bodies content in the second reaction zone.

The hydrotreating of organosulfur, organonitrogen and/or color bodies contained in the hydrocarbon feedstocks or effluents typically includes exothermic reactions. The heat generated from such reactions may increase the temperature of downstream portions of a catalyst bed. However, such transfer of heat downstream along a single catalyst bed, as in a single bed adiabatic reactor, as well as in the integrated multi-reactor process, is controlled in the present invention. In the process of the invention at a particular downstream location in the catalyst bed, a transfer of heat downstream is typically reduced by introduction of a coolant fluid (such as fresh hydrogen quench gas or cold hydrocarbon liquid product) so as to conform to the temperature required to obtain the desired concentration of organosulfur, organonitrogen and/or color bodies. An advantage of the multiple reactor embodiments is the placement of feedstock/effluent heat exchangers between reactors to effectively control downstream reactor temperatures and also to effect a mildly lower downstream reactor pressure.

The desired amount of color bodies remaining in the hydrocarbon product, particularly the amount remaining in the most-downstream reaction zone, depends upon such factors as the extent of color body conversion possible at a temperature that provides a given reaction rate constant for the particular feedstock. In the second reaction zone the color body conversion of a straight-run diesel/FCC light oil blended feedstock can be maximized in the temperature range from about 425° F. to about 575° F., and more particularly in the range from about 450° F. to about 550° F. Other factors include the activity of the catalyst, the concentration of color bodies in the hydrocarbon liquid or vapor contacting the catalyst, operating conditions, and the like. In the single reactor embodiment, the upstream portion of the overall catalyst bed usually contains greater than about 50 volume percent of the catalyst whereas the remaining downstream portions (at the lower temperature) of the overall catalyst bed usually contain less than 50 volume percent and ordinarily about 5 to about 45, and preferably about 15 to about 40 volume percent of the catalyst. In the multi-reactor embodiments, the upstream and downstream portions of the overall catalyst bed, i.e. the sum of all the catalyst in all the reactors, contain the same relative catalyst volume percentages as in the single reactor embodiment. As a consequence, in the multi-reactor embodiments, the ratio of the space velocities (calculated as LHSV) of the downstream to the upstream reactor is usually greater than 1.2, and preferably greater than 1.5, and most preferably in the range from about 2.0 to about 10.

When the temperatures of downstream reaction zones are lowered relative to the upstream zones, the overall process of the invention results in a significantly reduced color body content as compared to an overall process employing the same catalyst at the same temperature in upstream and downstream reaction zones. Furthermore, in the invention, the hydrotreating activity of the particulate catalyst employed at high and low temperatures is maintained for a considerably longer period of time than in the process employing the catalyst at the constantly higher temperature.

Moreover, the overall multi-reactor, high-low temperature process of the invention can reduce reactor volume compared to a process operated at an intermediate temperature in multiple reaction zones, while still providing simultaneous improvement in color, desulfurization and denitrogenation. For instance, in a typical 10,000 barrel per day throughput of a diesel fuel feedstock, a single conventional hydrotreating reactor may operate at a LHSV of 0.5, e.g., 833 barrels of reactor volume (i.e., capacity), to meet both color and sulfur/-nitrogen product specification. However, in the invention, the upstream reactor, targeted primarily for sulfur/nitrogen removal, may operate at a LHSV of 1.5, e.g. 278 barrels of reactor volume, while the downstream reactor, targeted primarily for color removal, may operate at a LHSV of 10, e.g. 42 barrels of reactor volume, to meet similar color and sulfur/nitrogen product specification. Such a reduction of reactor capacity from 833 to 320, by utilizing the process of the invention, provides an overall reduction in reactor volume of more than 50 percent.

The invention is further illustrated by the following example which is illustrative of specific modes of practicing the invention and are not intended as limiting the scope of the invention as defined in the appended claims.

EXAMPLE

In an embodiment of the invention involving two separate reactors, a hydrotreating catalyst is successively contacted in each of two connected reactors for 30 days under a constant hydrogen partial pressure of 595 p.s.i.g. for the first 7 days and 613 p.s.i.g. for the remaining 23 days (recycle gas rate of 2,000 scf/bbl,) with a feedstock containing a diesel fuel blend of 80 volume percent straight-run diesel and 20 volume percent light oil obtained from a fluid catalytic cracking process and boiling in the range from about 375° F. to about 705° F. and initially containing about 1.28 weight percent of organosulfur (calculated as S), 300 ppmw of organonitrogen (calculated as N) and a color value of L 1.0 (as measured by color test ASTM D-1500).

The catalyst, containing nickel, molybdenum and phosphorus and having a mode pore diameter about 83 angstroms (i.e., a catalyst similar to Catalyst B in the Example of U.S. Pat. No. 4,686,030), is initially contacted with the feedstock in the first reactor at a temperature of 675° F. and is then contacted in the downstream reactor with the entire effluent product obtained from the preceding upstream reactor at a lower temperature of 450° F. The effluent product obtained from the upstream reactor contains (1) a diesel fuel fraction having a color value of L 1.0 (as measured by color test ASTM D-1500) and a lower organosulfur and organonitrogen content than contained in the feedstock, e.g., 501 ppmw as S and 73 ppmw as N, (2) ammonia from organonitrogen compound conversion, (3) hydrogen sulfide from organosulfur compound conversion, and (4) unreacted hydrogen. During the process, the WABT of the catalyst in the first reactor is maintained at the initial temperature of 675° F., and then in the second reactor the WABT is lowered by approximately 225° F. (i.e., 450° F.), and the liquid hourly space velocities in the upstream and downstream reactors are 3 and 10, respectively. Both the inlet and outlet temperatures of the downstream reactor are lower than the inlet or outlet temperatures of the upstream first reactor.

During essentially the entire 30-day processing run, a finished product diesel fuel obtained from the effluent of the downstream reactor has essentially the same organosulfur and organonitrogen content (e.g., 502 ppmw as S, 75 ppmw as N) as the effluent obtained from the upstream reactor and has a significantly lighter color. The finished product diesel fuel has an average color value of +11 as measured by color test ASTM D-156 (Saybolt). This is an increase of at least 25 Saybolt color value whole numbers compared to the feedstock. (The color of the finished product diesel fuel is consistently lighter than L O.0 on the ASTM D-1500 test, thus, the lighter color scale of the ASTM D-156 test is utilized.) The downstream reactor conditions are thus shown to be sufficient to convert a substantial amount of color body bodies to non-color bodies in a finished product diesel fuel.

While particular embodiments of the invention have been described, it will be understood, of course, that the invention is not limited thereto since many obvious modifications can be made, and it is intended to include within this invention any such modifications as will fall within the scope of the invention as defined by the appended claims.

We claim:

1. An integrated two stage process for improving the color of a feedstock containing hydrocarbon components and organosulfur or organonitrogen compounds, said process comprising:

contacting a first hydrotreating catalyst in a first reaction zone with said feedstock under hydrotreating conditions including the presence of hydrogen and an elevated temperature and hydrogen partial pressure to produce an effluent having a reduced organonitrogen content compared to said feedstock and an organosulfur content less than 800 ppmw sulfur, calculated as S, and contacting a second hydrotreating catalyst in a downstream second reaction zone with essentially all of said effluent under hydrotreating conditions including a higher space velocity than in said first reaction zone, a hydrogen partial pressure less than 620 p.s.i.g. and an elevated temperature which is (1) lower than the temperature in said first reaction zone and (2) sufficient to lighten the color of said effluent.

2. The process defined in claim 1 wherein a hydrogen partial pressure in said downstream second reaction zone is at least 5 p.s.i.g. lower than that in said first reaction zone.

3. The process defined in claim 1 wherein a weighted average catalyst bed temperature in said downstream second reaction zone is at least 50° F. lower than that in said first reaction zone.

4. The process defined in claim 1 wherein a weighted average catalyst bed temperature in said downstream second reaction zone is in the range from 100° F. to 400° F. lower than that in said first reaction zone.

5. The process defined in claim 1 wherein said feedstock contains essentially no lube oils and is selected from the group consisting of light coker gas oil, straight-run diesel fuel, hydrocracked diesel fuel and light cycle oil obtained from a fluid catalytic cracking process.

6. The process defined in claim 1 wherein said hydrotreating conditions in said first reaction zone comprise a temperature above 600° F., a total pressure above 200 p.s.i.g., a liquid hourly space velocity from about 0.1 to about 5 and recycle gas rate from about 400 to about 4,000 standard cubic feet per barrel of feedstock and said hydrotreating conditions in said downstream second reaction zone comprise a temperature from about 250° F. to about 750° F., a liquid hourly space velocity from about 6 to about 25, and a total pressure lower than in said first reaction zone.

7. The process in claim 1 wherein said feedstock has a kinematic viscosity in the range from 1 to 5 centistoke at 40° C.

8. The process in claim 1 wherein said color is lightened by an increase of at least about 10 whole numbers on the color scale measured by the ASTM D-156 test.

9. The process defined in claim 1 wherein said feedstock contains about 0.1 to about 4 weight percent of organosulfur compounds, calculated as S, and said effluent contains less than about 500 ppmw of organosulfur compounds, calculated as S.

10. The process defined in claim 1 wherein said feedstock contains about 100 to about 4,000 ppmw organonitrogen, calculated as N, and said effluent contains less than about 500 ppmw organonitrogen, calculated as N.

11. The process defined in claim 1 wherein less than 50 percent conversion of said organosulfur or organonitrogen occurs in said downstream second reaction zone and said hydrotreating catalyst contains at least 17 weight percent of molybdenum components, calculated as $MoO_3$.

12. The process defined in claim 1 wherein an inlet hydrogen partial pressure in said second reaction zone is in the range from about 500 to about 600 p.s.i.g.

13. The process defined in claim 1 wherein the catalyst volume of said downstream second reaction zone is smaller than that in said first reaction zone and the liquid hourly space velocity in said downstream second reaction zone is greater than 5.0.

14. The process defined in claim 1 wherein the volume of said second hydrotreating catalyst in said downstream second reaction zone is smaller than that of said hydrotreating catalyst in said first reaction zone and said feedstock contains greater than about 1.25 weight percent of sulfur, calculated as S.

15. The process defined in claim 1 wherein the inlet hydrogen partial pressure in said first and said second reaction zone is in the range from about 490 to less than 620 p.s.i.g.

16. The process defined in claim 1 wherein said color is lightened by a decrease of at least 0.5 whole numbers on the color scale as measured by the ASTM D-1500 test or by an increase of at least 3 whole numbers on the color scale as measured by the ASTM D-156 color test.

17. The process defined in claim 1 wherein the liquid hourly space velocity of said effluent from said first reaction zone through said downstream second reaction zone is at least 1.5 times greater than the liquid hourly space velocity of said feedstock passing through said first reaction zone and said hydrotreating catalyst comprises at least one Group VIB metal hydrogenation component and/or at least one Group VIII metal hydrogenation component and at least one phosphorus component on a porous refractory support.

18. The process defined in claim 1 wherein said first and said second reaction zones comprise separate integrated reactors and essentially no hydrogen sulfide or ammonia is removed from said effluent prior to said effluent contacting said second hydrotreating catalyst in said second reaction zone.

19. The process defined in claim 1 wherein said downstream second reaction zone is located in a downstream portion of the same reactor having said first reaction zone.

20. An integrated multi-reaction zone catalytic process for improving the color and oxidation stability of a feedstock comprising a diesel fuel containing organosulfur or organonitrogen compounds each in concentrations of at least 10 ppmw sulfur or nitrogen, calculated as S or N, respectively, and a kinematic viscosity of less than 5 centistokes at 40° C., said process comprising:

contacting, in a first reaction zone, a hydrotreating catalyst comprising at least one hydrogenation metal component supported on a refractory oxide with said feedstock under hydrotreating conditions including a weighted average catalyst bed temperature in the range from about 600° F. to about 750° F., a hydrogen partial pressure from about 300 to about 1,800 p.s.i.g. and a liquid hourly space velocity from about 0.1 to about 4 to produce an effluent containing (a) hydrogen sulfide or ammonia, and (b) said diesel fuel containing a reduced organosulfur content compared to said feedstock, and subsequently contacting, in a downstream second reaction zone, a second hydrotreating catalyst or a second portion of said hydrotreating catalyst with essentially all of said effluent under hydrotreating conditions including a weighted average catalyst bed temperature in the range from about 250° F. to about 650° F. and lower than said weighted average catalyst bed temperature in said first reaction zone, a hydrogen partial pressure from about 300 to less than 620 p.s.i.g. and lower than in said first reaction zone, and a liquid hourly space velocity from about 6 to about 20, said temperature sufficient to produce a product diesel fuel from said second reaction zone which is lighter in color than that of said diesel fuel contained in said effluent.

21. The process defined in claim 20 wherein said weighted average catalyst bed temperature in said downstream second reaction zone is at least 50° F. lower than that in said first reaction zone.

22. The process defined in claim 20 wherein said feedstock contains essentially no lube oils and is selected from the group consisting of light coker gas oil, straight-run diesel fuel, hydrocracked diesel fuel and light cycle oil obtained from a fluid catalytic cracking process.

23. The process defined in claim 20 wherein said color is lightened by a decrease of at least 0.5 whole numbers on the color scale as measured by the ASTM D-1500 color test.

24. The process in claim 20 wherein said color is lightened by an increase of at least about 3 whole numbers on the color scale measured by the ASTM D-156 color test.

25. The process defined in claim 20 wherein said effluent contains less than 800 ppmw of said organosulfur compounds and less than 50 percent conversion of said organosulfur or organonitrogen occurs in said downstream second reaction zone.

26. The process defined in claim 20 wherein an inlet hydrogen partial pressure in said second reaction zone is in the range from about 500 to about 600 p.s.i.g.

27. The process defined in claim 20 wherein the hydrotreating catalyst volume of said downstream second reaction zone is smaller than that in said first reaction zone and said feedstock contains greater than about 1.25 weight percent of sulfur, calculated as S, and said hydrotreating catalysts utilized in said first and second reaction zones comprise at least one phosphorus component on a porous refractory oxide.

28. The process defined in claim 20 wherein the volume of said second hydrotreating catalyst or said second portion of said hydrotreating catalyst in said downstream second reaction zone is between 1.2 and 10 times smaller than that of said hydrotreating catalyst in said first reaction zone.

29. The process defined in claim 25 wherein said first and said second reaction zones comprise separate integrated reactors and essentially none of said hydrogen sulfide or ammonia is removed from said effluent prior to said effluent contacting said second hydrotreating catalyst or said second portion of said hydrotreating catalyst in said downstream second reaction zone and said hydrogen partial pressure in said downstream second reaction zone is about 25 to about 75 p.s.i.g. lower than that in said first reaction zone, and said hydrotreating catalyst further comprises at least 17 weight percent of molybdenum components, calculated as $MoO_3$.

30. The process defined in claim 20 wherein said downstream second reaction zone is located in a downstream portion of the same reactor having said first reaction zone and is cooled by (1) a hydrogen quench gas or (2) a cooled recycled diesel fuel obtained from said downstream second reaction zone.

31. An integrated multi-reaction zone catalytic process for improving the color of a diesel fuel containing organosulfur and organonitrogen, said diesel fuel containing components selected from the group consisting of (1) light coker gas oil, (2) straight-run diesel, (3) hydrocracked diesel and (4) light cycle oil obtained from a fluid catalytic cracking process, said process comprising:

contacting, in a first reaction zone, a hydrotreating catalyst comprising at least one Group VIB or Group VIII hydrogenation metal component supported on an alumina-containing porous refractory oxide with said diesel fuel under hydrotreating conditions including the presence of hydrogen, a weighted average catalyst bed temperature in the range from about 600° F. to about 800° F., a hydrogen partial pressure from about 200 to about 1,800 p.s.i.g. and a liquid hourly space velocity from about 0.5 to about 5.0 to produce an effluent containing hydrogen, hydrogen sulfide, ammonia and a second diesel fuel containing a reduced organonitrogen content compared to said diesel fuel and from 0 to 800 ppmw of said organosulfur compounds, calculated as S, and subsequently contacting a second portion of said hydrotreating catalyst or a second hydrotreating catalyst in a downstream second reaction zone with essentially all of said effluent under mild hydrotreating conditions including a weighted average catalyst bed temperature in the range from about 250° F. to about 625° F. and at least 100° F. lower than said weighted average catalyst bed temperature in said first reaction zone, an inlet hydrogen partial pressure from about 490 to less than 620 p.s.i.g. and lower than in said first reaction zone, a recycle gas rate in the range from 700 scf/bbl to 5,000 scf/bbl, and a liquid hourly space velocity from about 6 to about 15, said mild hydrotreating conditions sufficient to lighten the color of said second diesel fuel and produce a third diesel fuel having either a greater whole number color value than that of said second diesel fuel, as measured by the ASTM D-156 color test, or a smaller color value number than that of said second diesel fuel, as measured by the ASTM D-1500 test.

32. The process defined in claim 31 wherein said third diesel fuel obtained from said second reaction zone has a color value greater than −10, as measured by the ASTM D-156 color test.

33. The process defined in claim 31 wherein the hydrotreating catalyst volume of said downstream second reaction zone is smaller than that in said first reaction zone and said organosulfur content is less than about 500 ppmw, calculated as S.

34. The process defined in claim 31 wherein the volume of said second hydrotreating catalyst or said second portion of said hydrotreating catalyst in said downstream second reaction zone is about 1.5 to about 10 times smaller than that of said hydrotreating catalyst in said first reaction zone.

35. The process defined in claim 31 wherein said first and said second reaction zones comprise separate integrated reactors and essentially none of said hydrogen sulfide and ammonia is removed from said effluent prior to said effluent contacting said second hydrotreating catalyst or said hydrotreating catalyst in said downstream second reaction zone and the total pressure in said downstream second reaction zone is about 3 to about 100 p.s.i.g. lower than that in said first reaction zone.

36. A catalytic process for improving the color of a feedstock containing a substantial proportion of hydrocarbon components boiling at a temperature less than 700° F., and an organosulfur content in the range from 0 to about ppmw of sulfur, calculated as S, and said process comprising:

contacting a hydrotreating catalyst with said feedstock under mild hydrotreating conditions including a liquid hourly space velocity greater than 5.0, a hydrogen partial pressure less than 620 p.s.i.g. and a temperature which is (1) in the range from about 250° F. to about 650° F. and (2) sufficient to lighten the color of said hydrocarbon components contained in said feedstock.

37. The process defined in claim 36 wherein a weighted average catalyst bed temperature is in the range from 250° F. to 550° F., and said hydrotreating catalyst comprises at least 19 weight percent of molybdenum hydrogenation component, calculated as $MoO_3$, and at least one phosphorus component on a porous refractory oxide.

38. The process defined in claim 36 wherein said feedstock contains essentially no lube oils and is selected from the group consisting of light coker gas oil, straight-run diesel fuel, hydrocracked diesel fuel and light cycle oil obtained from a fluid catalytic cracking process.

39. The process defined in claim 36 wherein said hydrotreating conditions comprise a temperature in the range from about 440° F. to about 560° F., a hydrogen partial pressure from about 490 to less than 620 p.s.i.g., a liquid hourly space velocity from about 6 to about 25 and a recycle gas rate from about 400 to about 4,000 standard cubic feet per barrel of feedstock.

40. The process in claim 36 wherein said color is lightened by an increase of at least about 10 whole numbers on the color scale measured by the ASTM D-156 test.

41. The process defined in claim 36 wherein an inlet hydrogen partial pressure is in the range from 570 to less than 620 p.s.i.g.

42. The process defined in claim 36 wherein said color is lightened by a decrease of at least 0.5 whole numbers on the color scale as measured by the ASTM D-1500 color test or by an increase of at least 3 whole numbers on the color scale as measured by the ASTM D-156 color test.

43. The process defined in claim 36 wherein said feedstock further comprises at least one component selected from the group consisting of organosulfur compounds, organonitrogen compounds, hydrogen sulfide and ammonia.

* * * * *